US011167777B2

(12) United States Patent
Vande Sande et al.

(10) Patent No.: US 11,167,777 B2
(45) Date of Patent: Nov. 9, 2021

(54) RAILCAR BRIDGE PLATE KIT RETAINER

(71) Applicant: Trinity Rail Group, LLC, Dallas, TX (US)

(72) Inventors: Jerry W. Vande Sande, Dallas, TX (US); Kyle R. Coston, Forney, TX (US); Robert J. Cencer, Tipton, MI (US)

(73) Assignee: TRINITY RAIL GROUP, LLC, Dallas, TX (US)

( * ) Notice: Subject to any disclaimer, the term of this patent is extended or adjusted under 35 U.S.C. 154(b) by 366 days.

(21) Appl. No.: 16/531,361

(22) Filed: Aug. 5, 2019

(65) Prior Publication Data

US 2020/0276991 A1 Sep. 3, 2020

Related U.S. Application Data

(60) Provisional application No. 62/811,610, filed on Feb. 28, 2019.

(51) Int. Cl.
*B61D 3/18* (2006.01)

(52) U.S. Cl.
CPC ..... *B61D 3/187* (2013.01)

(58) Field of Classification Search
CPC ..... B61D 3/187; B61D 3/188; B61D 47/005; B61D 3/18; B62D 33/0273; B62D 33/033; B62D 33/037; B60P 1/43; B60P 7/0807; E05C 2003/128; E05C 3/12; Y10T 292/1043; Y10T 292/1063; Y10T 292/29
See application file for complete search history.

(56) References Cited

U.S. PATENT DOCUMENTS

| | | | | |
|---|---|---|---|---|
| 453,553 | A * | 6/1891 | Estes | E05B 15/0093 292/230 |
| 517,605 | A * | 4/1894 | Dolliver | E05B 15/0093 292/230 |
| 3,195,478 | A * | 7/1965 | Thompson | B61D 3/187 105/458 |
| 4,686,909 | A * | 8/1987 | Burleson | B61D 3/187 105/378 |
| 6,550,400 | B1 * | 4/2003 | Forbes | B61D 3/184 105/404 |
| 6,857,376 | B2 * | 2/2005 | Coslovi | B01D 53/1412 105/458 |

* cited by examiner

*Primary Examiner* — Mark T Le
(74) *Attorney, Agent, or Firm* — Baker Botts, LLP

(57) ABSTRACT

A retaining apparatus includes a retaining catch and a latch. The retaining catch is attached at a first end of a bridge plate kit of the railcar. The latch is disposed on a deck of the railcar. The latch includes a stationary portion attached to the deck and a pendulum portion rotationally coupled to the stationary portion. The pendulum portion rotates about an axis in and through the stationary portion. The pendulum portion includes a stop preventing rotation of the pendulum portion through the stationary portion beyond a stop angle. The retaining catch causes the pendulum portion to rotate from a first position to a second position away from the bridge plate kit. The pendulum portion rotates back to the first position after the bridge plate kit has been flipped over. The pendulum portion in the first position retains the bridge plate kit in the flipped over position.

20 Claims, 7 Drawing Sheets

RAILCAR BRIDGE PLATE KIT RETAINER

RELATED APPLICATION

This application claims the benefit under 35 U.S.C. § 119(e) of the priority of U.S. Provisional Application No. 62/811,610 entitled "RAILCAR BRIDGE PLATE KIT RETAINER" filed on Feb. 28, 2019, the entire disclosure of which is hereby incorporated by reference.

TECHNICAL FIELD

This disclosure relates generally to railcars, and more particularly to bridge plate kits used on railcars.

BACKGROUND

Railcars may transport cargo between locations using single or multi-deck configurations. For example, automobile manufacturers may ship vehicles on railcars. Vehicles or other cargo may be transferred between railcars or loaded on and off railcars onto other transportation vehicles, such as trailers. Bridge plates may provide a bridge between adjacent railcars or a railcar and another location, thereby enabling the movement of cargo from the railcar currently holding the cargo. For example, an auto rack (a railcar configured to transport vehicles) may include one or more bridge plates stored within the auto rack. During an unload procedure, the bridge plates may be moved into position to provide a bridge to another auto rack such that the vehicles may be moved over the bridge plates into the other auto rack.

Railcars may also include a bridge plate kit (also referred to as a "flipper plate") that provides an attachment point between the bridge plate and the railcar. For example, the bridge plate kit may be fastened to a portion of the railcar and include one or more barrel rings through which a portion of the bridge plate may be disposed, thereby coupling the bridge plate to the railcar. The bridge plate kit may provide certain advantages, such as protecting the barrel rings from being damaged from coupler bypasses and allowing for the use of a raised end door track (as opposed to a recessed door track).

SUMMARY

According to an embodiment, a retaining apparatus includes a retaining catch and a latch. The retaining catch is attached to a bridge plate kit of a railcar at a first end of the bridge plate kit. The latch is disposed on a deck of the railcar. The latch includes a stationary portion attached to the deck and a pendulum portion rotationally coupled to the stationary portion. The pendulum portion is configured to rotate about an axis in and through the stationary portion. The pendulum portion includes a stop configured to prevent the rotation of the pendulum portion through the stationary portion beyond a stop angle. The latch is disposed proximate the retaining catch when the bridge plate kit is flipped over for use with a bridge plate. The retaining catch is configured to cause the pendulum portion to rotate from a first position to a second position away from the bridge plate kit while bridge plate kit is being flipped over for use with the bridge plate. The pendulum portion is configured to rotate back to the first position after the bridge plate kit has been flipped over. The pendulum portion in the first position retains the bridge plate kit in the flipped over position via the retaining catch.

According to another embodiment, a railcar includes an opening end, a deck portion, a bridge plate kit, and a retaining apparatus. The opening end includes an opening through which cargo may be loaded onto or unloaded from the railcar. The deck portion extends from the railcar at the opening end of the railcar. The bridge plate kit is coupled to the railcar and flips over away from the railcar for use with a bridge plate. The retaining apparatus includes a retaining catch and a latch. The retaining catch is attached to a bridge plate kit of a railcar at a first end of the bridge plate kit. The latch is disposed on a deck of the railcar. The latch includes a stationary portion attached to the deck and a pendulum portion rotationally coupled to the stationary portion. The pendulum portion is configured to rotate about an axis in and through the stationary portion. The pendulum portion includes a stop configured to prevent the rotation of the pendulum portion through the stationary portion beyond a stop angle. The latch is disposed proximate the retaining catch when the bridge plate kit is flipped over for use with a bridge plate. The retaining catch is configured to cause the pendulum portion to rotate from a first position to a second position away from the bridge plate kit while bridge plate kit is being flipped over for use with the bridge plate. The pendulum portion is configured to rotate back to the first position after the bridge plate kit has been flipped over. The pendulum portion in the first position retains the bridge plate kit in the flipped over position via the retaining catch.

According to yet another embodiment, a method for retaining a bridge plate kit of a railcar in an operating position. The method includes flipping over a bridge plate kit from a storage position proximate an opening end of a railcar. The bridge plate kit includes a retaining catch disposed at a first end of the bridge plate kit. The method further includes causing the retaining catch to interact with a latch disposed on the deck of the railcar. The latch includes a stationary portion attached to the deck and a pendulum portion rotationally coupled to the stationary portion. The pendulum portion is configured to rotate about an axis in and through the stationary portion. The pendulum portion includes a stop configured to prevent the rotation of the pendulum portion through the stationary portion beyond a stop angle. Causing the retaining catch to interact with the latch causes the pendulum portion to rotate from a first position to a second position away from the bridge plate kit while bridge plate kit is being flipped over for use with the bridge plate. The pendulum portion is configured to rotate back to the first position after the bridge plate kit has been flipped over and retain the bridge plate kit in the flipped over position via the retaining catch.

Certain embodiments of the present disclosure may provide one or more technical advantages. For example, certain embodiments provide a retaining apparatus that can be selectively engaged to restrain the movement of a bridge plate kit during loading or offloading of cargo from a railcar. In this manner, weight placed on the opposite end of the bridge plate from the bridge plate kit will not cause the bridge plate kit to rotate significantly, thereby maintaining the clearance between the railcar and a portion of the cargo. As another example, certain embodiments provide a passive retaining mechanism that only requires gravity to engage the bridge plate kit once flipped over. In this manner, less maneuvering of the bridge plate kit and retaining mechanism are required, which may aid the operator and reduce the risk of injuries. As yet another example, certain embodiments provide a restorative force device with the retaining apparatus, which maintains the engaged portion of the retaining apparatus in place over the bridge plate kit. As a result, the bridge plate kit may be secured even when subject to vibrations and other forces that may result from the transportation of cargo, such as cars, over the bridge plate and bridge plate kit.

Certain embodiments may have none, some, or all of the above-recited advantages. Other advantages may be readily apparent to one having skill in the art.

BRIEF DESCRIPTION OF THE DRAWINGS

For a more complete understanding of this disclosure, reference is now made to the following brief description, taking in connection with the accompanying drawings and detailed description, wherein like reference numerals represent like parts.

DETAILED DESCRIPTION

Despite the advantages of using a flippable bridge plate kit described above, the combination of the bridge plate kit with a bridge plate may pose certain challenges when loading/unloading cargo, such as vehicles from the railcar. For example, uneven loads on a connected bridge plate during loading/unloading of cargo may cause the bridge plate kit to flip up and contact a portion of the cargo, such as the undercarriage of a vehicle.

Embodiments of the present disclosure and its advantages are best understood by referring to FIGS. 1 through 7 of the drawings, like numerals being used for like and corresponding parts of the various drawings. Although certain embodiments may be described in reference to particular illustrated examples, the disclosure herein is not limited to the particular illustrated embodiments and/or configurations and includes any and all variants of the illustrated embodiments and any and all systems, methods, or apparatuses consistent with the teachings of this disclosure, as understood by a person having ordinary skill in the art.

Figure 1A:
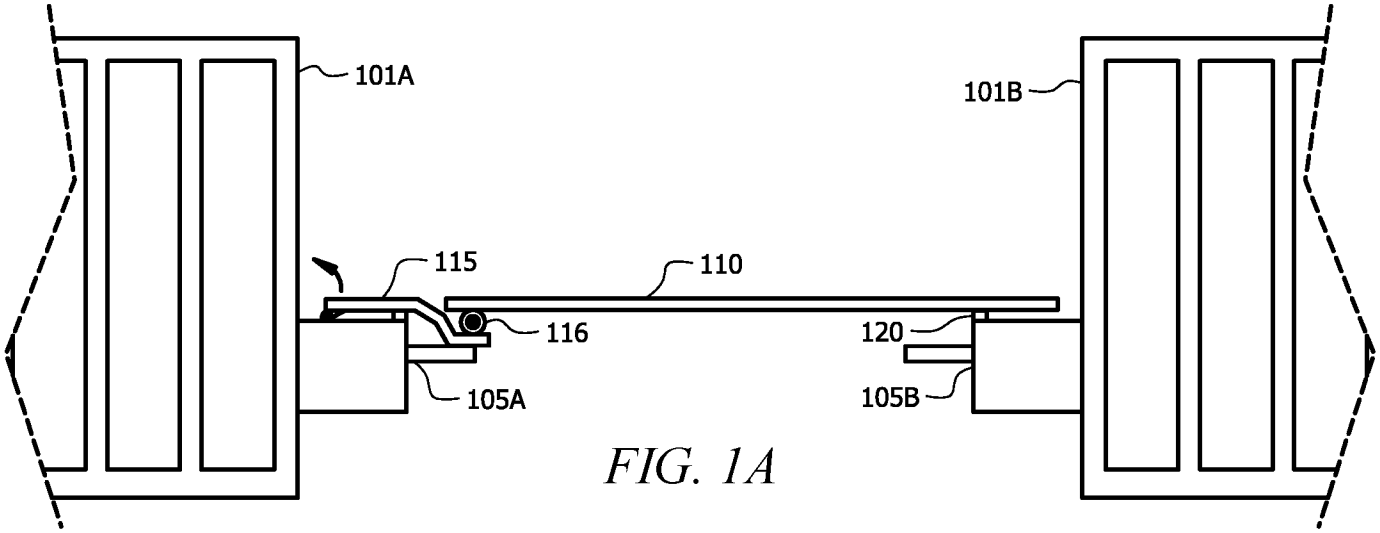
FIGS. 1A and 1B illustrate a bridge plate kit and bridge plate spanning two railcars in an unloaded position and a loaded position, respectively, in accordance with certain embodiments.
Figure 1B:
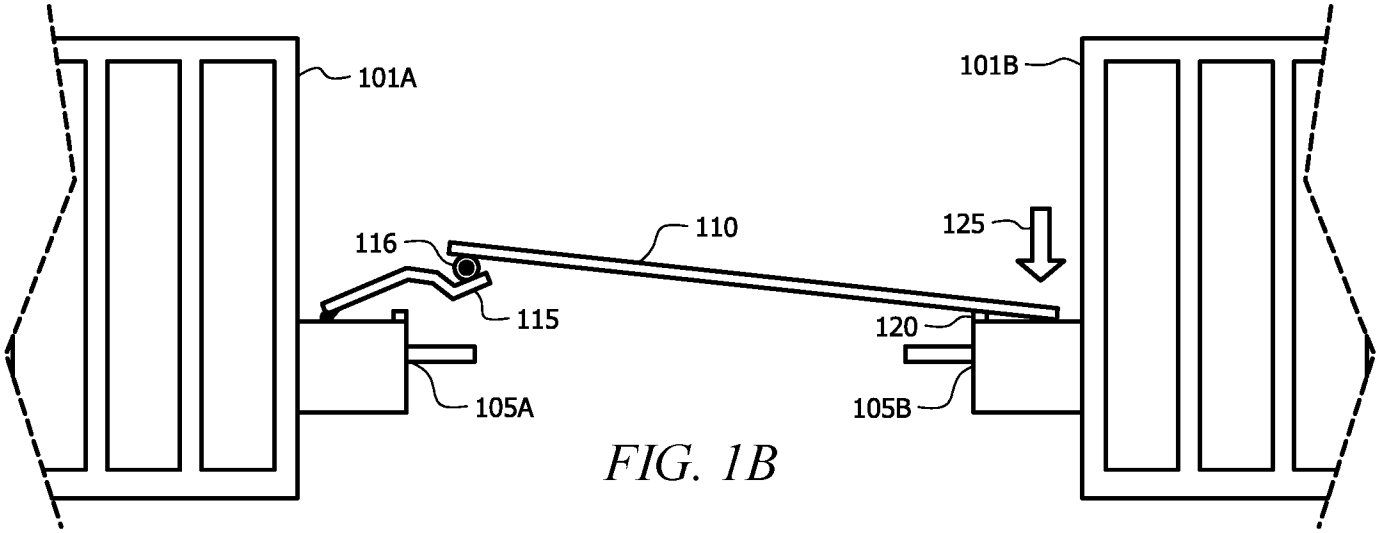

FIG. 1A and FIG. 1B illustrate a common scenario using a bridge plate kit with a bridge plate between railcars. FIG. 1A illustrates bridge plate 110 spanning from a first railcar 101A to a second railcar 101B. Bridge plate 110 may be supported on a deck 105A of first railcar 101A using bridge plate kit 115. Bridge plate kit 115 may be rotated from a storage position inside of first railcar 101A to the illustrated position on deck 105A for use with bridge plate 110. Bridge plate 110 may be coupled to first railcar 101A via bridge plate kit 115. For example, in certain embodiments, bridge plate kit 115 may include one or more barrel rings 116, through which a portion of bridge plate 110 may be disposed. The opposite side of bridge plate 110 may be disposed on a deck 105B of second railcar 101B. In some embodiments, a portion of bridge plate 110 disposed on deck 105B may rest on a pivot point 120. Pivot point 120 may be any point on deck 105B or second railcar 101B that creates a pivot or fulcrum for bridge plate 110. Pivot point 120 may result from having uneven heights between decks 105A and 105B of first railcar 101A and second railcar 101B and/or irregular surfaces crated by storable bridge plates or bridge plate kits. Accordingly, certain configurations of bridge plate kits 115 and bridge plates 110 may create a two fulcrum or two pivot point bridge between first and second railcars 101A and 101B.

FIG. 1B illustrates bridge plate 110 spanning from first railcar 101A to second railcar 101B with an uneven load 125 applied at the free end of bridge plate 110. The combination of the two fulcrum points, barrel rings 116 and pivot point 120, allows the freedom of movement of the combined bridge plate kit 115 and bridge plate 110 to rise from the decks 105A and 105B of railcars 101A and 101B. In particular, if load 125 is placed to the right of pivot point 120, the opposite end of bridge plate 110 may be lifted. Since this end of bridge plate 110 is coupled to bridge plate kit 115, it may lift the coupled portion of bridge plate kit 115 with that end of bridge plate 110, thereby rotating bridge plate kit 115 up away from deck 105A of first railcar 101A. When this occurs, the clearance between bridge plate 110 and bridge plate kit 115 and any cargo or vehicle above the barrel rings 116 is reduced.

As a specific example, first railcar 101A and second railcar 101B may be auto racks and a vehicle is being moved from second railcar 101B to first railcar 101A. As the first set of tires traverse bridge plate 110 load 125 may exist in the illustrated location, thereby causing bridge plate kit 115 to rise. This may not cause any issues if nothing else is disposed over bridge plate 110 and bridge plate kit 115. As the first set of tires of the vehicle cross over to the middle of bridge plate 110 and over bridge plate kit 115 into first railcar, bridge plate kit 115 may remain pressed down against deck 105A since the weight on the bridge plate is not centered beyond pivot point 120. However, if the second set of tires traverse bridge plate 110 after the first set of tires have moved beyond bridge plate 110 and bridge plate kit 115, load 125 may result once again. This time, however, a portion of the vehicle is disposed over bridge plate kit 115 near its barrel rings 116. Thus, the rotation of bridge plate kit 115 upwards may result in undesirable contact with the vehicle, such as the vehicle's rocker panels and/or exhaust systems. Contact may be made if the combination of load 125, the distance from pivot point 120 at which load 125 is applied, and the relative lengths of bridge plate 110 and bridge plate kit 115 are such that the rise of bridge plate kit 115 exceeds the clearance of the undercarriage of the vehicle. Because vehicles or other cargo of various sizes, shapes, and weights may be transported by railcars 101A and 101B, this type of undesired contact may difficult to avoid by merely adjusting the dimensions of bridge plates 110 and bridge plate kits 115. Thus, what is desired are other solutions that may prevent this undesired movement of bridge plate kit 115 resulting from load 125. Described below are several example embodiments of retaining apparatuses that may prevent the movement of bridge plate kit and have certain other advantages, as described herein.

Figure 2:
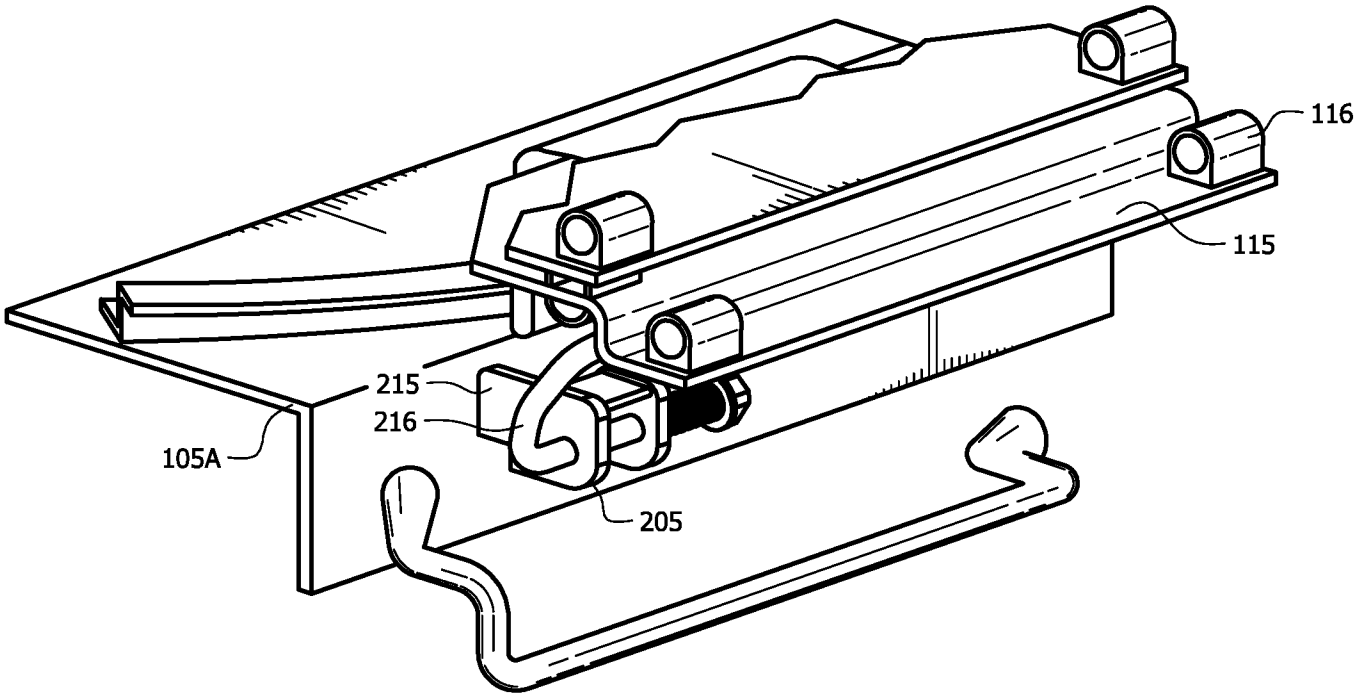
FIG. 2 illustrates a bridge plate kit with an example retaining apparatus, in accordance with certain embodiments.

FIG. 2 illustrates bridge plate kit 115 with an example retaining apparatus 205, in accordance with certain embodiments. Retaining apparatus 205 may be disposed underneath bridge plate kit 115. For example, in certain embodiments, retaining apparatus 205 may be attached to deck 105A of railcar 101A proximate one side of bridge plate kit 115. Retaining apparatus 205 may be configured to be engaged or disengaged, thereby allowing bridge plate kit 115 to be selectively restrained. In this manner, retaining apparatus 205 may prevent the undesired upward movement of bridge plate kit 115 as previously described. For example, a portion of retaining apparatus 205 may be selectively disposed over a portion of bridge plate kit 115 such that movement of bridge plate kit 115 is restrained, at least in the undesired upwards direction. Retaining apparatus 205 may be engaged when the portion of retaining apparats 205 is disposed over bridge plate kit 115 and disengaged when that portion is not disposed over bridge plate kit 115.

Retaining apparatus 205 may include a retainer 210 and an attachment portion 215, according to certain embodiments. Retainer 210 may include the portion of retaining apparatus 205 that is disposed over bridge plate kit. For example, retainer 210 may be shaped such that a portion of retainer may be disposed over bridge plate kit 215 while still being coupled to attachment portion 215. In some embodiments, retainer 210 may have a cane shape or a U-shape, as shown in the illustrated example. In these examples, one of the ends of the cane or U may be disposed over bridge plate kit 115 while the other end is coupled to attachment portion 215. Retainer 210 may include any suitable shape that allows it to restrain the movement of bridge plate kit 115 and be selectively engaged/disengaged.

In certain embodiments, retainer 210 may be coupled to attachment portion 215 such that affixing attachment portion 215 to the end of a railcar situates retainer 210 proximate the location of bridge plate kit 115 when it is flipped over for use. Retainer 210 may be configured to move relative to attachment portion 215, allowing retainer 210 to move between engaged and disengaged positions or orientations. For example, retainer 210 may be coupled to attachment portion 210 such that retainer is pivotable about a single axis and translatable along that same axis. Retaining apparatus 205 may be disposed relative bridge plate kit 115 such that the translation axis is parallel to bridge plate kit 115 and such that retainer 210 may be translated on that axis to selectively dispose a portion of retainer 210 over bridge plate kit 115. For example, retaining apparatus 205 may be disposed underneath the location of bridge plate kit 115 when flipped over proximate a side of bridge plate kit 115. Retaining apparatus 205 may be oriented such that retainer 210 may move relative to attachment portion 215 to allow retainer 210 to be disposed over bridge plate kit 115 or removed from over bridge plate kit 115.

As shown in FIG. 2, one end of retainer 210 may be disposed over bridge plate kit 115 in an engaged position. To disengage retaining apparatus 205, retainer 210 may be moved away from bridge plate kit 115 and rotated downward, underneath bridge plate kit 115. This may allow bridge plate kit 115 to be flipped back over into railcar 101A and stored for transport, etc. To engage retaining apparatus 205 when bridge plate kit 115 may be in the flipped over position, retainer 210 is pulled away from bridge plate kit 115. Once retainer 210 is able to clear bridge plate 115, retainer 210 may be rotated upwards, above bridge plate kit 115. Retainer 210 may then be moved towards bridge plate kit 115 to dispose a portion of retainer 210 over bridge plate kit. Because retainer 210 is coupled to attachment portion 215 that is affixed to a fixed location of railcar 101A, retainer 210 may prevent the movement of bridge plate kit 115 when retaining apparatus 205 is engaged in the above manner.

Various alterations or different implementations are also contemplated herein. In some embodiments, the location and orientation of retaining apparatus 205 may be altered from the illustrated example in FIG. 2. For example, retaining apparatus 205 may be attached to railcar 101A at a different location, e.g., a different side of bridge plate kit 115, on both sides of bridge plate kit 115, or not directly underneath the location of bridge plate kit 115 when flipped over. In particular, the location of retaining apparatus 205 may be adjusted based on the size and shape of bridge plate kit 115 and or the attached bridge plate 110. Furthermore, the location of retaining apparatus 205 may be adjusted depending on the size and shape of retainer 210. For example, the size and shape of retainer 210 may depend on how secure bridge plate kit 115 needs to be, e.g., based on the typical weight or torque anticipated for typical cargo. In particular, retainer 210 may be configured to have a larger portion of retainer 210 disposed over bridge plate kit 115 when engaged. This may include increasing the length of the exposed end of retainer 210, e.g., having the cane portion extend longer over bridge plate kit 215. In this manner, the described retaining apparatus 205 may be suitably configured for a variety of railcars and bridge plate kits.

Figure 3:
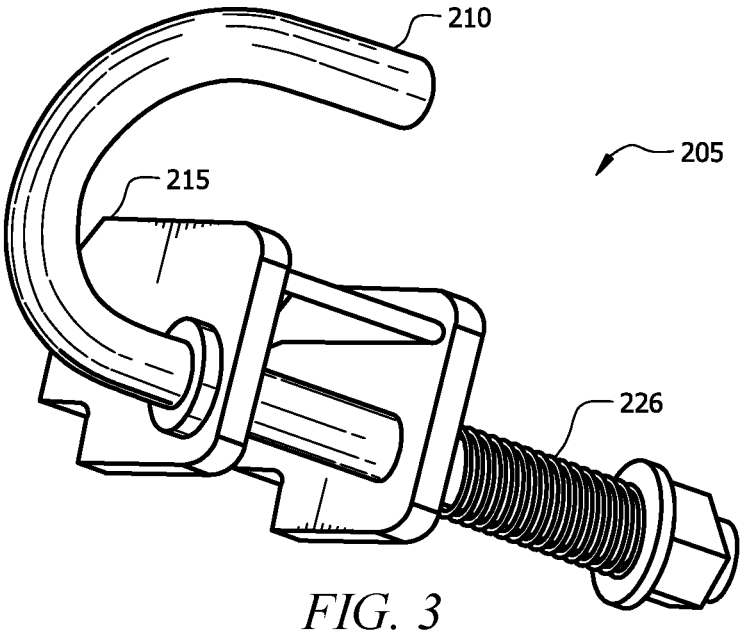
FIG. 3 illustrates the example retaining apparatus of FIG. 2, in accordance with certain embodiments.

FIG. 3 illustrates retaining apparatus 205, in accordance with certain embodiments. As described above, retaining apparatus 205 may include retainer 210 and attachment portion 215. In certain embodiments, retaining apparatus 205 may further include a spring 220, or any other suitable opposing displacement force mechanism, coupled to retainer 210 and attachment portion 215. Spring 220 may be configured to oppose the translation of retainer 210 away from attachment portion 215, e.g., away from a neutral position relative to attachment portion 215. For example, if retainer 210 is pulled away from attachment portion 215, spring 220 may oppose the movement and if retainer 210 is no longer being pulled, cause retainer 210 to back towards attachment portion 215.

The inclusion of spring 220 may be useful in restraining the movement of bridge plate kit 115 throughout the unloading/loading process. For example, after bridge plate kit 115 is flipped over for use, retainer 210 may be pulled out from attachment portion 215, rotated over bridge plate kit 115, and released. Spring 220 may ensure that retainer 210 is pulled back towards attachment portion 215, which positions a portion of retainer 210 over bridge plate kit 115, thereby securing bridge plate kit 115 in a secure flipped-over position. Furthermore, spring 220 may ensure that retainer 210 remains in the secured position during unloading/loading. For example, the displacement force of spring 220 may counteract any inadvertent or unintentional sideways forces that may dislodge or move retainer 210 away from over bridge plate kit 115. In particular, a loading car causes bridge plate kit 115 and/or bridge plate 110 may move horizontally and cause retainer 210 to move in the same direction. Without spring 220, or another suitable mechanism, retainer 210 may remain in the displaced position even if bridge plate kit 115 is moved back into its original position. Therefore, spring 220 may prevent retaining apparatus 205 from being disengaged unintentionally.

Figure 4:
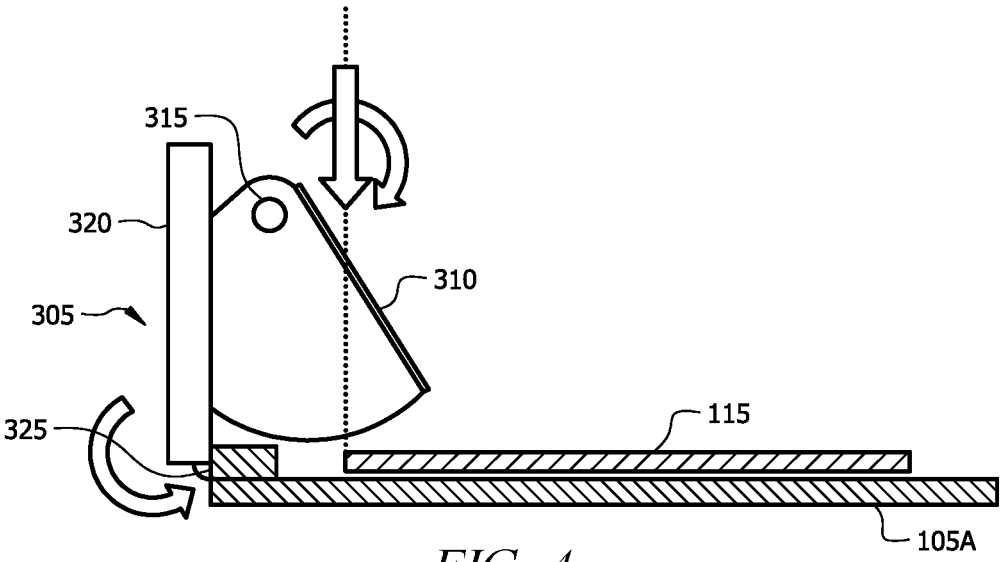
FIG. 4 illustrates a bridge plate kit with a second example retaining apparatus, in accordance with certain embodiments.

FIG. 4 illustrates bridge plate kit 115 with a second example retaining apparatus 305, in accordance with certain embodiments. Retaining apparatus 305 may operate differently from retaining apparatus 205. For example, retaining apparatus 305 may include latch 310 that pivots about a pivot 315. In certain embodiments, latch 310 is a passive latch that latches automatically as a result of gravity. For example, retaining apparatus 305 may be configured to automatically pivot retainer 310 into a position such that a portion of retainer 310 is disposed over bridge plate kit 115, thereby restraining bridge plate kit 115's movement.

In certain embodiments, pivot 315 may be coupled to a bracket or another support fastened to the railcar. The position of pivot 315 relative to bridge plate kit 115 may be controlled to ensure that there is sufficient clearance for the movement of latch 310 away from bridge plate kit 115 and to ensure that a sufficient portion of latch 310 is disposed over bridge plate kit 115 when retaining apparatus 305 is engaged to prevent movement of bridge plate kit 115. In this manner, retaining apparatus 305 may be suitably secured within the railcar at the appropriate location to selectively secure bridge plate kit 115. In some embodiments, two retaining apparatus 305 are positioned on opposite sides of the railcar to each secure one of the bridge plate kits 115.

Retaining apparatus 305 may also include a backstop portion 320. Backstop portion 320 may be configured to prevent rotation of latch 310 beyond a certain angle or distance. For example, backstop portion 320 may extend away from latch 310 such that part of backstop portion 320 engages with a stop 325 or another portion of the railcar when latch 310 has pivoted a certain angle over bridge plate kit 115. In this manner, latch 310 may be free to pivot about pivot 315 without interference until reaching the appropriate position.

In certain embodiments, backstop portion 320 may be weighted to ensure that latch 310 rotates to the appropriate position. For example, a larger proportion of the weight of retaining apparatus 305 may be distributed in backstop portion 320 such that gravity acts on retaining apparatus 305 to rotate backstop portion 320 downward. Accordingly, the combination of backstop portion 320 and latch 310 may create a passive gravity latch that moves to the engaged position over bridge plate kit 115 by itself.

In certain embodiments, retaining apparatus 305 may be configured to pivot away from bridge plate kit 115 when bridge plate kit 115 is flipped over into the use position. For example, latch 310 may be configured such that when bridge plate kit 115 is flipped over, on top of latch 310, bridge plate kit 115 pushes latch 310 away from bridge plate kit 115 (e.g., to the left in the illustrated example in FIG. 4). By pushing latch 310 away, bridge plate kit 115 may be fully flipped over for use with bridge plate 110. However, once bridge plate kit 115 reaches its final location for use with bridge plate 110, bridge plate kit 115 may no longer prevent the movement of latch 310, which may automatically pivot about pivot 315 into the engaged position, as described above.

Once bridge plate kit 115 is no longer needed, it may be flipped back over into the railcar. This may require disengaging retaining apparatus 305 by pushing latch 310 away from bridge plate kit 115, thereby allowing bridge plate kit 115 to rotate. For example, an operator may push latch 310 with his foot or hand or another implement while he or another operator flips over bridge plate kit 115 into railcar 101A. In some embodiments, a handle or another mechanism may be coupled to latch 310 to cause it to pivot without directly contacting latch 310. As a result, bridge plate kit 115 may be suitably stored within railcar 101A. Retaining apparatus 305 may return to the engaged position without bridge plate kit 115 disposed underneath until bridge plate 115 is flipped back out for further use.

Accordingly, several embodiments of retaining apparatuses for use with a bridge plate kit have been described that may address one or more of the problems identified in this disclosure. While certain components and configurations have been described with reference to retaining apparatuses 205 and 305, any suitable change, variation, alteration, transformation, or modification, is contemplated herein. For example, certain components may be modified or replaced with other similar or analogous components or certain components may be integrated into less components or distributed across multiple discrete components. While contemplated for use with a railcar, such as an autorack railcar, the retaining apparatuses described herein may be adaptable to any suitable application involving a rotating support as part of a two-fulcrum apparatus.

FIGS. 5A-D illustrate a third example restraining apparatus 400 for retaining flipper bridge plate kit 115 for use with a bridge plate, such as bridge plate 110 in FIG. 1. Restraining apparatus 400 may include a retaining catch 405 and pendulum latch 410. In certain embodiments, retaining catch 405 may be moved proximate pendulum latch 410 such that a portion of pendulum latch 410 prevents the movement of bridge plate kit 115 by restraining the movement of retaining catch 405. To free bridge plate kit 115 to be flipped back over for storage, e.g., during transportation or when bridge plate 110 is no longer used, the restraining portion of pendulum latch 410 may be moved out of the way before bridge plate kit 115 is flipped back over.

In certain embodiments, retaining catch 405 may be fastened or otherwise attached to a portion of bridge plate kit 115. In some embodiments retaining catch 405 is attached to an end of bridge plate kit 115 proximate a side of a railcar, e.g., railcar 101A/B. In this manner, retaining catch 405 may be positioned out of the way such that it does not interfere with the movement of cargo into or out of the railcar. Similarly, pendulum latch 410 may be disposed on a portion of the railcar, e.g., deck 105 of railcar 101A/B, and positioned such that retaining catch 405 interacts with pendulum latch 410 when bridge plate kit 115 is flipped over.

In certain embodiments, retaining catch 405 comprises an attachment plate configured to be fastened to bridge plate kit 115 and a u-shaped metal extension, the ends of which are attached to the attachment plate. As shown in the illustration, in some embodiments, the u-shaped metal extension extends perpendicularly from the attachment portion. Further, in certain embodiments, retaining catch 405 defines a space or hole through which a portion of pendulum catch 410 may be disposed, thereby retaining bridge plate kit 115 in the flipped over position. For example, the u-shaped metal extension and attachment portion of retaining catch 405 may define a hole configured to receive a portion of pendulum portion 415 it is in a closed or first position.

In certain embodiments, pendulum latch 410 includes a pendulum portion 415 and a stationary portion 425. Pendulum portion 415 may be configured to rotate while stationary portion 425 remains stationary, relative to railcar deck 105. As described in detail below, pendulum portion 415 of pendulum catch 410 may interact with retaining catch 405 to restrain the movement of bridge plate kit 115. Further, pendulum portion 415 may be moved to enable to movement of bridge plate kit 115, e.g., to flip it back into railcar 101A/B.

Figure 5A:
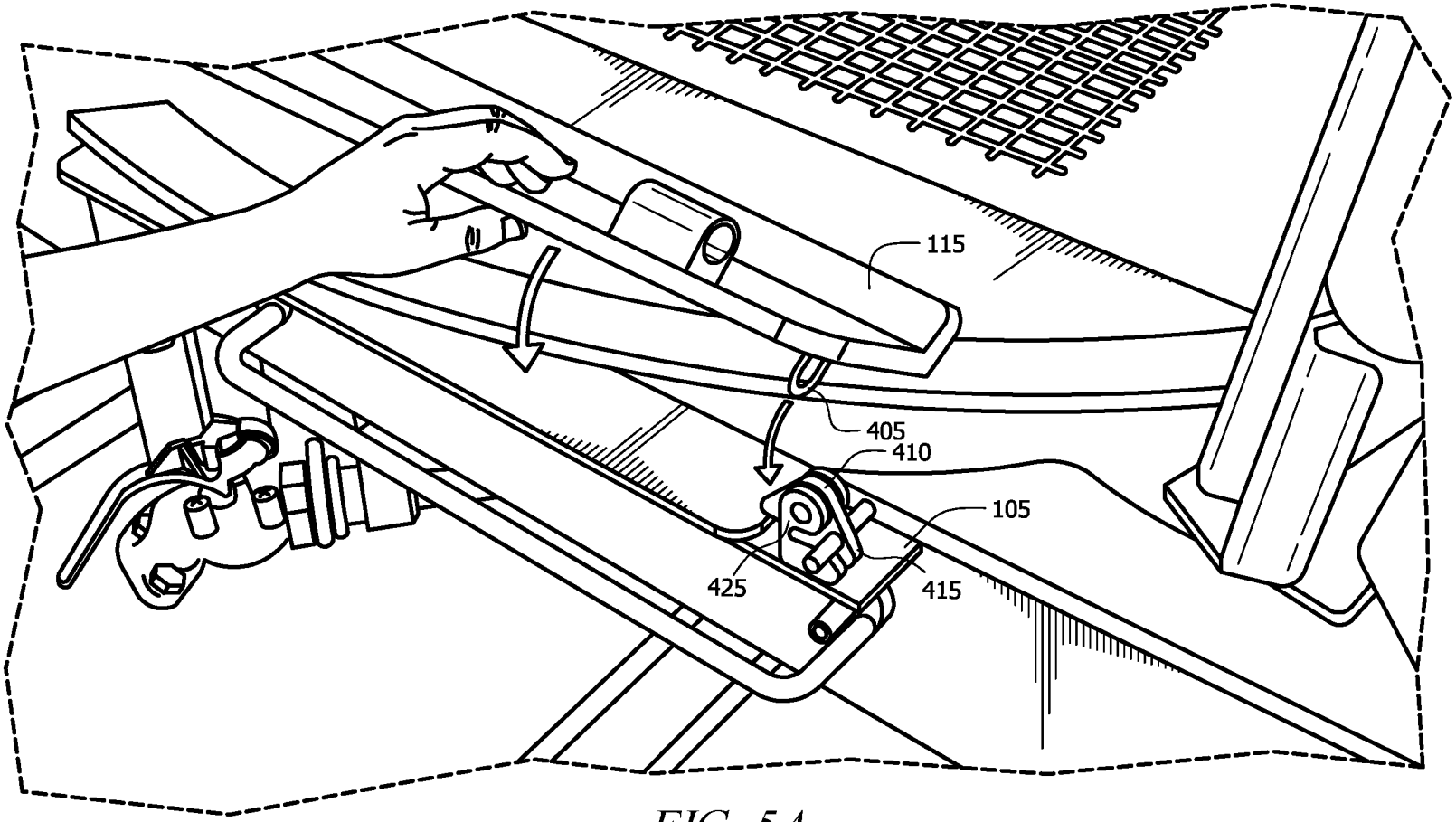
FIGS. 5A-D illustrate a bridge plate kit with a third example retaining apparatus, in accordance with certain embodiments.
Figure 5D:
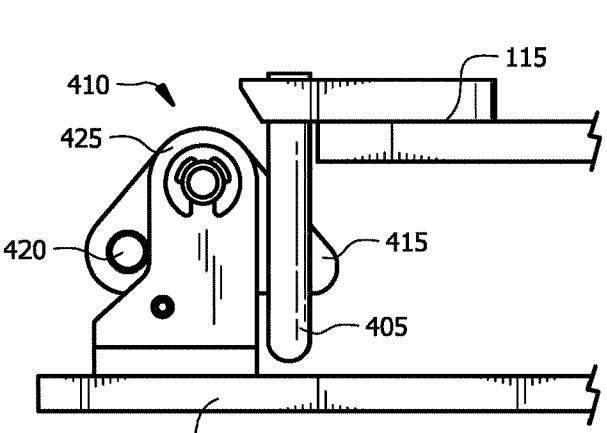
Figure 5C:
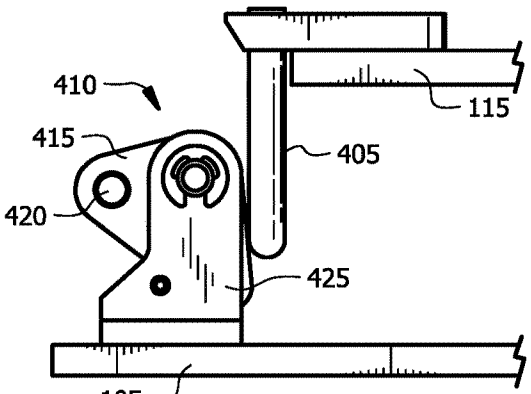
Figure 5B:
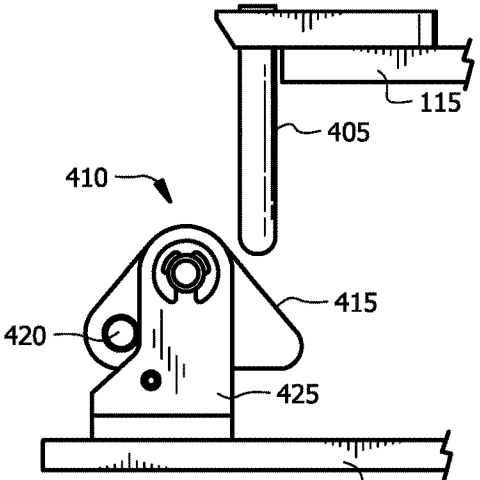

FIG. 5B-D illustrate a particular example of retaining bridge plate kit 115 in the flipped-over position, e.g., the position for use with bridge plate 110. FIG. 5B illustrates when bridge plate kit 115 is being flipped over, but before it is retained using restraining apparatus 400. As described herein, as bridge plate kit 115 is being flipped over, retaining catch 405 may be positioned above pendulum portion 415 of pendulum latch 410. In some embodiments, pendulum portion 415 includes a stop 420. Stop 420 may extend from pendulum portion 415 perpendicularly. Further, stop 420 may extend sufficiently far to engage with stationary portion 425 at a particular point of rotation of pendulum portion 410. In this manner, pendulum portion 410 is able to rotate to a particular position (e.g., before and after retaining catch 405 interacts with pendulum catch 410), without over rotating. The illustrated position Furthermore, stop 420 may provide a convenient point of contact for an operator to swing pendulum portion 415 away from retaining catch 405, thereby allowing bridge plate kit 115 to swing freely. For example, an operator may engage stop 420 to rotate pendulum portion 415 into a second position that allows retaining catch 405, and thereby bridge plate kit 115, to swing into railcar 101A/B.

FIG. 5C illustrates the interaction between retaining catch 405 and pendulum catch 410 during the retaining process of bridge plate kit 115. In particular, as retaining catch 405 is lowered above pendulum portion 415, retaining catch 405 pushes pendulum portion 415, thereby causing pendulum portion 415 to rotate out of the way into a second position from the first position. Since there is no stop on the other side of pendulum portion 415, pendulum portion 415 may freely rotate into the second position, as shown in the illustrated example. In certain embodiments, no additional human operation is required to move pendulum portion 415 into the second position out of the way of retaining catch 405. For example, an operator may flip bridge plate kit 115 over for use without having to separately interact with retaining catch 405 and/or pendulum catch 410. Accordingly, no additional operation is required to engage restraining apparatus 400.

FIG. 5D illustrates the latching of pendulum latch 410 within retaining catch 405. As shown in FIG. 5C, retaining catch 405 moves downward next to stationary portion 425 of pendulum latch 410. Once bridge plate kit 115 is positioned in its final flipped over position, the space or hole defined by retaining catch 405 is oriented even with pendulum portion 415. In this manner, pendulum portion 415 may swing back into the first position, placing a portion of pendulum portion 415 through retaining catch 405. In some embodiments, pendulum portion 415 swings back into the first position of FIG. 5D automatically using gravity when the defined hole or space of retaining catch 405 is in a certain position, e.g., when bridge plate kit 115 is completely flipped over. Accordingly, bridge plate kit 115 may be retained because pendulum portion 415 of pendulum latch 410 prevents the movement of retaining catch 405 that is coupled to bridge plate kit 115. In this manner, restraining apparatus 400 may retain a bridge plate kit of a railcar.

To disengage restraining apparatus 400, pendulum portion 415 of pendulum latch 410 may be rotated back to the second position (e.g., that shown in FIG. 5C), thereby removing any portion of pendulum portion 415 disposed through retaining catch 405. For example, an operator may use a hand, foot, or tool to push or pull pendulum portion 415 via stop 420 to rotate pendulum portion 415 from the first position, restraining bridge plate kit 115, to the second position. Accordingly, restraining apparatus 400 may selectively retain bridge plate kit 115 in the flipped over position until it needs to be stored or otherwise flipped back over into the railcar.

In certain embodiments, retaining apparatus further includes another retaining catch 405/pendulum latch 410 pair. For example, a second retaining catch may be disposed on an opposite side of bridge plate kit 115 and a second pendulum latch disposed on deck 105 such that the pair are proximate when bridge plate kit 115 is flipped over, as described above with respect to retaining catch 405 and pendulum latch 410. In this manner, bridge plate kit 115 may be secured on both sides, thereby securing bridge plate kit 115 evenly. Accordingly, in some embodiments, there are one or two retaining catches 405 disposed on bridge plate kit 115 and a corresponding number of pendulum latches 410 disposed on deck 105.

Figure 6:
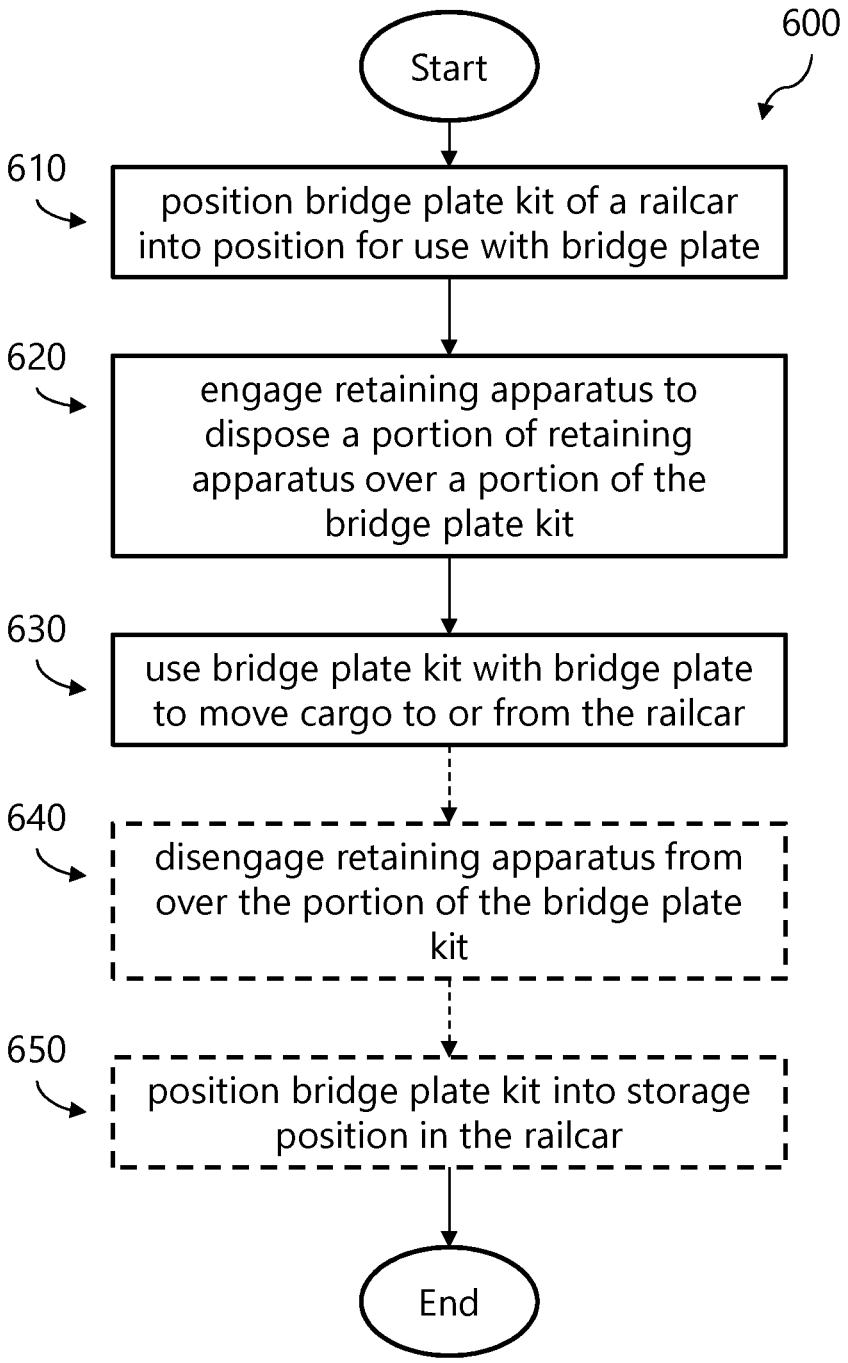
FIG. 6 illustrates a first example method of restraining a bridge plate kit with a retaining apparatus, in accordance with certain embodiments.

FIG. 6 illustrates a first example method 600 of restraining a bridge plate kit with a retaining apparatus, in accordance with certain embodiments. Method 600 may begin at step 610, wherein a bridge plate kit, such as bridge plate kit 115 or any other flipper plate used with a railcar, is positioned into a position for use with a bridge plate, e.g., bridge plate 110. For example, the bridge plate kit may be flipped from a storage position inside of the railcar into a position protruding from the deck of the railcar, thereby exposing the barrel rings of the bridge plate kit for use with the bridge plate. The bridge plate kit may be secured into this position prior to its use to load or offload cargo from the railcar.

At step 620, a retaining apparatus, such as retaining apparatus 205 or retaining apparatus 305, may be engaged to dispose a portion of the restraining apparatus over the bridge plate kit. For example, a portion of the retaining apparatus may be moved from an initial position away from bridge plate kit to an engaged position over bridge plate kit. As one example, retainer 210 of retaining apparatus 205 may be moved away from attachment portion 215 and rotated over bridge plate kit 115 and moved back towards attachment portion 215. As another example, retainer 310 of retaining apparatus 305 may pivot away from bridge plate kit 115 when it is flipped over in the previous step and automatically pivot back over bridge plate kit. In this manner, a portion of the retaining apparatus may be positioned to prevent the movement of the bridge plate kit.

At step 630, the bridge plate kit is used with the bridge plate to move cargo to or from the railcar. For example, the bridge plate kit may be coupled to the bridge plate that provides a bridge for transporting cargo, such as vehicles, to or from the railcar. With the application of the retaining apparatus, bridge plate kit may be restrained from rotating away from the railcar, thereby preventing undesired contact between a portion of the bridge plate kit or bridge plate with the cargo.

In certain embodiments, method 600 may include one or more additional, optional steps. In certain embodiments, method 600 may include one or both of optional steps 640 and 650. For example, after using the bridge plate kit to move cargo, at step 640, the retaining apparatus may be disengaged from over the portion of the bridge plate kit. As a particular example, retainer 210 of retaining apparatus 205 may be moved away from over bridge plate kit 115 and rotated out of the way to disengage retaining apparatus 205. As another example, retainer 310 of retaining apparatus 305 may be pivoted via pivot 315 away from over bridge plate kit 115 to disengage retaining apparatus 305. In this manner, the retaining apparatus may be disengaged, thereby allowing the bridge plate kit to be moved from the position used for load or unloading cargo.

At optional step 650, the bridge plate kit may be positioned into a storage position within the railcar. For example, with the restraining apparatus disengaged, the bridge plate kit may be free to rotated back into railcar such that the bridge plate kit is no longer extending from the end of the railcar and the barrel rings are no longer exposed. As a result, the railcar may be readied for transportation after using retaining apparatus.

Figure 7:
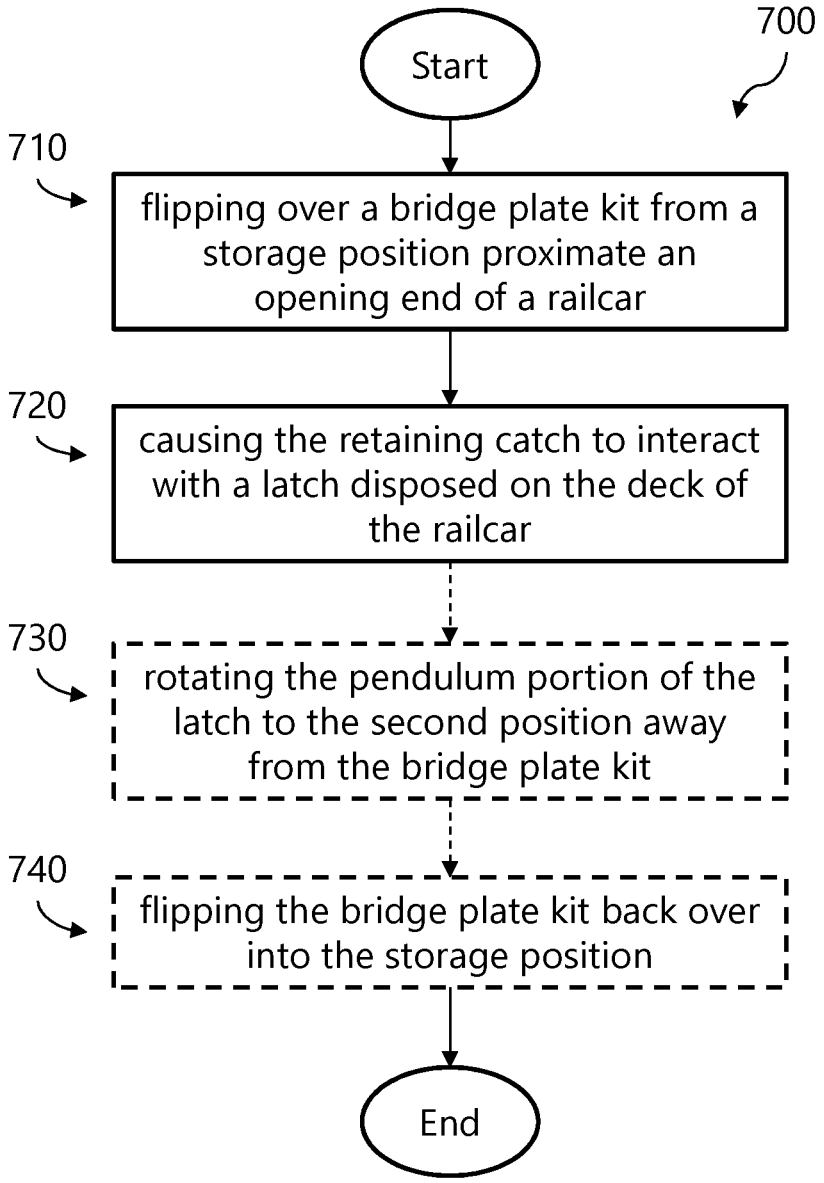
FIG. 7 illustrates a second example method of restraining a bridge plate kit with a retaining apparatus, in accordance with certain embodiments.

FIG. 7 illustrates a second example method 700 of restraining a bridge plate kit with a retaining apparatus, in accordance with certain embodiments. Method 700 may begin at step 710, where a bridge plate kit, e.g., bridge plate kit 115, is flipped over from a storage position proximate an opening end of a railcar. The bridge plate kit includes a retaining catch disposed at a first end of the bridge plate kit. For example, bridge plate kit 115 may be flipped over with retaining catch 405 disposed at one end of the bridge plate kit 115, as described above.

At step 720, the retaining catch is caused to interact with a latch disposed on the deck of the railcar. For example, the retaining catch may interact with a pendulum latch, such as pendulum latch 410. The latch disposed on the deck of the railcar may include a stationary portion (e.g., stationary portion 425) attached to the deck and a pendulum portion (e.g., pendulum portion 415) rotationally coupled to the stationary portion. As described above, the pendulum portion may rotate about an axis in and through the stationary portion and include a stop that prevents the rotation of the pendulum portion through the stationary portion beyond a stop angle.

The retaining catch to interacting with the latch causes the pendulum portion to rotate from a first position to a second position away from the bridge plate kit while bridge plate kit is being flipped over for use with the bridge plate. For example, pendulum portion 415 may rotate from a first position, e.g., as illustrated in FIG. 5B, to a second position, e.g., as illustrated in FIG. 5C, thereby allowing the bridge plate kit to be completely flipped over into its final position for use with a bridge plate. The latch retains the bridge plate kit in the flipped over position via the retaining catch.

In certain embodiments, the pendulum portion automatically rotates back to the first position after the bridge plate kit has been flipped over. For example, pendulum portion 415 may include a particular distribution of mass and position of its rotating axis such that gravity causes pendulum portion 415 to rotate to the first position, e.g., as illustrated in FIG. 5D. Accordingly, the latch may automatically secure bridge plate kit into its flipped over position, thereby preventing any inadvertent damage to cargo such as vehicles being transported from the railcar using the bridge plate kit and a bridge plate.

In certain embodiments, method 700 may include one or more optional steps. In a particular embodiment method 700 further includes steps 730 and 740 including rotating the pendulum portion of the latch to the second position away from the bridge plate kit and when the pendulum portion of the latch is in the second position, flipping the bridge plate kit back over into the storage position. In this manner, the latch may be disengaged from the retaining catch, thereby freeing the bridge plate kit to be rotated and flipped back over for storage and/or transportation. In some embodiments, the pendulum portion of the latch may be operated by a force applied to the stop of the pendulum portion. For example, the stop may be configured as a handle that can be operated to move the pendulum portion from the first position to the second position, thereby allowing the bridge plate kit to be flipped back into the railcar.

In certain embodiments, method 700 may further include fastening one or more of the retaining catch to the bridge plate kit and the latch to the deck of the railcar. For example, in certain embodiments, a railcar may be provided without a retaining apparatus. The retaining catch may be fastened to a portion of the bridge plate as a retrofit to the railcar. Similarly, the latch may be fastened to a portion of the deck of the railcar so that the two can operate together, as described herein. The retaining catch and latch may be fastened in any suitable way, including by fasteners such as nuts and bolts or by welding or any type of bonding. The retaining catch and/or latch may be made from any suitable material, including any suitable metal, such as aluminum or steel.

Modifications, additions, or omissions may be made to methods 600 and/or 700 depicted in FIGS. 6 and 7, respectively. Methods 600 and or 700 may include more, fewer, or other steps. Additionally, steps may be performed in parallel or in any suitable order. While discussed as retaining apparatus 205, retaining apparatus 305, or retaining apparatus 400 as performing certain steps, any suitable component of retaining apparatus 205, retaining apparatus 305, or retaining apparatus 400 may perform one or more steps of the methods. Additionally, methods 600 and/or 700 may include any suitable step to carry out any of the described functions retaining apparatus 205, retaining apparatus 305, or retaining apparatus 400.

In addition, techniques, systems, subsystems, and methods described and illustrated in the various embodiments as discrete or separate may be combined or integrated with other systems, modules, techniques, or methods without departing from the scope of the present disclosure. Other items shown or described as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

Example Embodiments

According to a first embodiment, a retaining apparatus includes an attachment portion and a retainer coupled to the attachment portion. The attachment portion is configured to be attached to a portion of a railcar proximate to a bridge plate kit. The retainer is configured to fit over a portion of the bridge plate kit when the bridge plate kit is flipped over for use with a bridge plate. As a result, the bridge plate kit is retained in a fixed position or fixed range of positions. The bridge plate kit is not retained in the fixed position or fixed range of positions when the retainer is disengaged from over the portion of the bridge plate kit.

In some embodiments, the retaining apparatus further includes a restorative force mechanism that opposes movement of the retainer from over the portion of the bridge plate kit.

In some embodiments, the retainer includes a hook portion and a rod portion connected to the hook portion. The hook portion of the retainer is disposed over the portion of the bridge plate kit when retaining the bridge plate kit and the rod portion is coupled to the attachment portion.

In some embodiments, the attachment portion is attached to a deck of the railcar underneath a portion of the deck on top of which the bridge plate kit is disposed when flipped over for use with a bridge plate.

In some embodiments, the bridge plate kit comprises one or more barrel rings through which the bridge plate is coupled to the bridge plate kit.

According to another embodiment, a retaining apparatus includes an attachment portion and a passive latch. The attachment portion is configured to be attached to a portion of a railcar proximate to a bridge plate kit. The passive latch is pivotable about an axis such that the passive latch is pivotable over a portion of the bridge plate kit when the bridge plate kit is flipped over for use with a bridge plate. As a result, the bridge plate kit is retained in a fixed position or fixed range of positions. The bridge plate kit is not retained in the fixed position or fixed range of positions when the passive latch is disengaged from over the portion of the bridge plate kit.

In some embodiments, the passive latch includes a counterbalance weight. The counterbalance weight provides a gravitational force about the axis that disposes the passive latch over the portion of the bridge plate kit.

In some embodiments, the retaining apparatus further includes a stop. The stop is configured to oppose the rotation of the passive latch about the pivotable axis after the passive latch as rotated a certain distance.

In some embodiments, the passive latch includes an interior engaging portion. The interior engaging portion is configured translate a translational force into a rotational force causing the passive latch to rotate about the axis to disengage from over the portion of the bridge plate kit.

In some embodiments, the passive latch is configured to pivot out of the way of the bridge plate kit as the bridge plate kit is flipped over for use with the bridge plate.

According to yet another embodiment, a method for retaining a bridge plate kit is provided. The method includes flipping over a bridge plate kit from an end of a railcar. The method further includes engaging a retainer apparatus to displace the retainer from a default position. The method further includes rotating the retainer of the retainer apparatus such that a portion of the retainer is disposed over a portion of the bridge plate kit. As a result, the bridge plate kit is retained in a fixed position or fixed range of positions.

In some embodiments, the method further includes engaging the retainer apparatus to displace the retainer from a default position. The method further includes rotating the retainer of the retainer apparatus such that a portion of the retainer is not disposed over a portion of the bridge plate kit. The method further includes flipping the bridge plate kit back into the end of the railcar.

According to a further embodiment, a method is provided for retaining a bridge plate kit. The method includes flipping over a bridge plate kit from an end of a railcar. Flipping over the bridge plate kit displaces a passive latch of the retaining apparatus. Once the bridge plate kit is flipped over, the passive latch is automatically disposed over a portion of the bridge plate kit. As a result, the bridge plate kit is retained in a fixed position or fixed range of positions. The method further includes engaging an interior engaging portion of the passive latch to rotate the passive latch away from over the portion of the bridge plate kit. The method further includes flipping the bridge plate kit back into the end of the railcar.

In some embodiments, the retaining apparatus is one of the retaining apparatus according to the earlier described example embodiments.

The invention claimed is:

1. A retaining apparatus, comprising:

a retaining catch attached to a bridge plate kit of a railcar, wherein the retaining catch is disposed at a first end of the bridge plate kit;

a latch disposed on a deck of the railcar, wherein the latch comprises:

a stationary portion attached to the deck; and a pendulum portion rotationally coupled to the stationary portion, wherein:

the pendulum portion is configured to rotate about an axis in and through the stationary portion; and the pendulum portion comprises a stop configured to prevent the rotation of the pendulum portion through the stationary portion beyond a stop angle;

wherein:

the latch is disposed proximate the retaining catch when the bridge plate kit is flipped over for use with a bridge plate;

the retaining catch is configured to cause the pendulum portion to rotate from a first position to a second position away from the bridge plate kit while bridge plate kit is being flipped over for use with the bridge plate; and the pendulum portion is configured to rotate back to the first position after the bridge plate kit has been flipped over, wherein the pendulum portion in the first position retains the bridge plate kit in the flipped over position via the retaining catch.

2. The retaining apparatus of claim 1, wherein the pendulum portion is further configured to rotate away from the flipped over bridge plate kit to the second position, wherein the bridge plate kit is able to be flipped back over when the pendulum portion is in the second position.

3. The retaining apparatus of claim 1, wherein the pendulum portion is configured to rotate back to the first position automatically using gravity after the bridge plate kit has been flipped over.

4. The retaining apparatus of claim 1, further comprising:

a second retaining catch attached to the railcar bridge plate kit, wherein the second retaining catch is disposed at a second end of the railcar bridge plate kit, the second end opposite the first end; and a second latch disposed on the deck of the railcar, the second latch comprising:

a stationary portion attached to the deck; and a pendulum portion rotationally coupled to the stationary portion, wherein:

the pendulum portion is configured to rotate about an axis in and through the stationary portion; and the pendulum portion comprises a stop configured to prevent the rotation of the pendulum portion through the stationary portion beyond a stop angle; and wherein the second latch is disposed proximate the second retaining catch when the bridge plate kit is flipped over for use with a bridge plate.

5. The retaining apparatus of claim 1, wherein the bridge plate kit comprises one or more barrel rings through which the bridge plate is coupled to the bridge plate kit.

6. The retaining apparatus of claim 1, wherein the stop of the pendulum portion comprises a handle portion extending along the rotational axis of the pendulum portion, wherein the handle portion is configured to translate a translational force incident thereupon into rotational movement of the pendulum portion between the first position and the second position.

7. The retaining apparatus of claim 1, wherein the retaining catch comprises:

an attachment plate configured to be fastened to the bridge plate kit at the first end; and a u-shaped metal extension comprising a first end and a second end, wherein the first end and the second end of the u-shaped metal extension are attached to the attachment plate;

wherein:

the u-shaped metal extension extends perpendicularly from the attachment portion; and the u-shaped metal extension and attachment portion defines a hole configured to receive a portion of the pendulum portion of the latch when the pendulum portion is in the first position.

8. A railcar, comprising:

an opening end that comprises an opening through which cargo may be loaded onto or unloaded from the railcar;

a deck portion extending from the railcar at the opening end of the railcar;

a bridge plate kit coupled to the railcar, wherein the bridge plate kit is configured to flip over away from the railcar for use with a bridge plate; and a retaining apparatus, comprising:

a retaining catch attached to the bridge plate kit, wherein the retaining catch is disposed at a first end of the bridge plate kit;

a latch disposed on the deck of the railcar, wherein the latch comprises:

a stationary portion attached to the deck; and a pendulum portion rotationally coupled to the stationary portion, wherein:

the pendulum portion is configured to rotate about an axis in and through the stationary portion; and the pendulum portion comprises a stop configured to prevent the rotation of the pendulum portion through the stationary portion beyond a stop angle;

wherein:

the latch is disposed proximate the retaining catch when the bridge plate kit is flipped over for use with the bridge plate;

the retaining catch is configured to cause the pendulum portion to rotate from a first position to a second position away from the bridge plate kit while bridge plate kit is being flipped over for use with the bridge plate; and the pendulum portion is configured to rotate back to the first position after the bridge plate kit has been flipped over, wherein the pendulum portion in the first position retains the bridge plate kit in the flipped over position via the retaining catch.

9. The railcar of claim 8, wherein the pendulum portion is further configured to rotate away from the flipped over bridge plate kit to the second position, wherein the bridge plate kit is able to be flipped back over when the pendulum portion is in the second position.

10. The railcar of claim 8, wherein the pendulum portion is configured to rotate back to the first position automatically using gravity after the bridge plate kit has been flipped over.

11. The railcar of claim 8, further comprising:

a second retaining catch attached to the railcar bridge plate kit, wherein the second retaining catch is disposed at a second end of the railcar bridge plate kit, the second end opposite the first end; and a second latch disposed on the deck of the railcar, the second latch comprising:

a stationary portion attached to the deck; and a pendulum portion rotationally coupled to the stationary portion, wherein:

the pendulum portion is configured to rotate about an axis in and through the stationary portion; and the pendulum portion comprises a stop configured to prevent the rotation of the pendulum portion through the stationary portion beyond a stop angle; and wherein the second latch is disposed proximate the second retaining catch when the bridge plate kit is flipped over for use with a bridge plate.

12. The railcar of claim 8, wherein the bridge plate kit comprises one or more barrel rings through which the bridge plate is coupled to the bridge plate kit.

13. The railcar of claim 8, wherein the stop of the pendulum portion comprises a handle portion extending along the rotational axis of the pendulum portion, wherein the handle portion is configured to translate a translational force incident thereupon into rotational movement of the pendulum portion between the first position and the second position.

14. The railcar of claim 8, wherein the retaining catch comprises:

an attachment plate configured to be fastened to the bridge plate kit at the first end; and a u-shaped metal extension comprising a first end and a second end, wherein the first end and the second end of the u-shaped metal extension are attached to the attachment plate;

wherein:

the u-shaped metal extension extends perpendicularly from the attachment portion; and the u-shaped metal extension and attachment portion defines a hole configured to receive a portion of the pendulum portion of the latch when the pendulum portion is in the first position.

15. A method for retaining a bridge plate kit of a railcar in an operating position, the method comprising:

flipping over a bridge plate kit from a storage position proximate an opening end of a railcar, wherein the bridge plate kit comprises a retaining catch disposed at a first end of the bridge plate kit; and causing the retaining catch to interact with a latch disposed on the deck of the railcar, wherein the latch comprises:

a stationary portion attached to the deck; and a pendulum portion rotationally coupled to the stationary portion, wherein:

the pendulum portion is configured to rotate about an axis in and through the stationary portion; and the pendulum portion comprises a stop configured to prevent the rotation of the pendulum portion through the stationary portion beyond a stop angle;

wherein causing the retaining catch to interact with the latch causes the pendulum portion to rotate from a first position to a second position away from the bridge plate kit while bridge plate kit is being flipped over for use with the bridge plate;

wherein the pendulum portion is configured to rotate back to the first position after the bridge plate kit has been flipped over and retain the bridge plate kit in the flipped over position via the retaining catch.

16. The method of claim 15, further comprising:

rotating the pendulum portion of the latch to the second position away from the bridge plate kit; and when the pendulum portion of the latch is in the second position, flipping the bridge plate kit back over into the storage position.

17. The method of claim 15, wherein:

the bridge plate kit comprises one or more barrel rings through which the bridge plate is coupled to the bridge plate kit; and the method further comprises coupling the bridge plate to the bridge plate kit after the bridge plate kit is in the flipped over position.

18. The method of claim 15, wherein the retaining catch comprises:

an attachment plate configured to be fastened to the bridge plate kit at the first end; and a u-shaped metal extension comprising a first end and a second end, wherein the first end and the second end of the u-shaped metal extension are attached to the attachment plate;

wherein:

the u-shaped metal extension extends perpendicularly from the attachment portion; and the u-shaped metal extension and attachment portion defines a hole configured to receive a portion of the pendulum portion of the latch when the pendulum portion is in the first position.

19. The method of claim 15, further comprising:

fastening the retaining catch to the bridge plate kit; and fastening the latch to the deck of the railcar.

20. The method of claim 15, wherein:

the bridge plate kit comprises a second retaining catch disposed at a second end of the bridge plate kit, the second end opposite the first end; and the method further comprises causing the second retaining catch to interact with a second latch disposed on the deck of the railcar, wherein the second latch prevents the movement of the second retaining catch and retains the bridge plate kit in the flipped over position via the second retaining catch.

* * * * *